US008997872B1

(12) United States Patent
Lugo

(10) Patent No.: US 8,997,872 B1
(45) Date of Patent: Apr. 7, 2015

(54) CAP ASSEMBLY FOR USE WITH A TUBING SPOOL OF A WELLHEAD

(75) Inventor: Mario R. Lugo, Houston, TX (US)

(73) Assignee: Trendsetter Engineering, Inc., Houston, TX (US)

( * ) Notice: Subject to any disclaimer, the term of this patent is extended or adjusted under 35 U.S.C. 154(b) by 163 days.

(21) Appl. No.: 13/401,997

(22) Filed: Feb. 22, 2012

(51) Int. Cl.
*E21B 34/04* (2006.01)
*E21B 33/12* (2006.01)

(52) U.S. Cl.
CPC ..... *E21B 33/1204* (2013.01)

(58) Field of Classification Search
CPC ..... E21B 33/035; E21B 33/037
USPC ..... 166/339, 344, 345, 350, 135, 368, 348; 251/1.1
See application file for complete search history.

(56) References Cited

U.S. PATENT DOCUMENTS

| | | | | |
|---|---|---|---|---|
| 3,638,722 | A * | 2/1972 | Talley, Jr. | 166/338 |
| 4,607,701 | A * | 8/1986 | Gundersen | 166/368 |
| 5,107,931 | A * | 4/1992 | Valka et al. | 166/342 |
| 5,299,641 | A | 4/1994 | Paulo et al. | |
| 7,596,996 | B2 | 10/2009 | Zollo et al. | |
| 2002/0134552 | A1 * | 9/2002 | Moss | 166/339 |
| 2004/0094311 | A2 * | 5/2004 | Hopper et al. | 166/382 |
| 2004/0104024 | A1 * | 6/2004 | Kent et al. | 166/85.4 |
| 2005/0205262 | A1 * | 9/2005 | Reimert et al. | 166/348 |
| 2007/0034379 | A1 | 2/2007 | Fenton et al. | |
| 2009/0255682 | A1 * | 10/2009 | Voss et al. | 166/344 |
| 2009/0260829 | A1 | 10/2009 | Mathis | |
| 2010/0006301 | A1 * | 1/2010 | Fenton | 166/368 |
| 2011/0036562 | A1 | 2/2011 | Braekke | |

FOREIGN PATENT DOCUMENTS

| | | | | |
|---|---|---|---|---|
| WO | WO 9733067 | A1 * | 9/1997 | E21B 33/035 |

* cited by examiner

*Primary Examiner* — James G Sayre
(74) *Attorney, Agent, or Firm* — Egbert Law Offices, PLLC

(57) ABSTRACT

A cap assembly for use with a tubing spool of a wellhead has a body with an interior passageway body and a mandrel extending upwardly therefrom. The body has a connector extending from an opposite end thereof. The interior passageway extends though the mandrel and the connector. A valve is affixed to the body and extends into the interior passageway. The valve is movable between a first position closing the interior passageway and a second position opening the interior passageway. An actuator is connected to the valve so as to move the valve between the first and second positions. A tubing hanger stab is affixed to the body and extends through the connector so as to join with a tubing hanger in the tubing spool.

9 Claims, 3 Drawing Sheets

CAP ASSEMBLY FOR USE WITH A TUBING SPOOL OF A WELLHEAD

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to techniques for capping wells. More particularly, the present invention the relates to apparatus and methods whereby an interim Christmas tree can be installed onto the tubing spool of a wellhead so as to close the wellhead for a period of time. Additionally, the present invention relates to system and methods for closing a subsea well with a capping system.

2. Description of Related Art Including Information Disclosed Under 37 CFR 1.97 and 37 CFR 1.98

A typical subsea wellhead assembly has a high pressure wellhead housing supported in a lower pressure wellhead housing and secured to casing that extends into the well. One or more casing hangers land in the wellhead housing. The casing hanger is located at the upper end of a string of casing that extends into the well to a deeper depth. A string of tubing extends through the casing for production fluids. A Christmas or production tree mounts to the upper end of the wellhead housing for controlling the well fluid. The production tree is typically a large and heavy assembly, having a number of valves and controls mounted thereon.

One type of Christmas tree has a pair of bores extending through it. One of bores is the production bore and the other is a tubing annulus access bore. In this type of wellhead assembly, the tubing hanger lands in the wellhead housing. The tubing hanger has two passages through it. One passage is the production passage and the other passage is an annulus passage that communicates with the tubing annulus surrounding the tubing. Access to the tubing annulus is necessary to circulate fluids down the production tubing and up through the tubing annulus, or vice versa, to either kill the well or circulate out heavy fluid during completion.

After the tubing hanger is installed and before the drilling riser is removed for installation of the tree, plugs are temporarily placed in the passages of the tubing hanger. The tree has isolation tubes that stab into engagement with the passages in the tubing hanger when the tree lands on the wellhead housing. This type of tree is normally run on a completion riser that has two strings of conduit. In a dual string completion riser, one string extends from the production passage of the tree to the surface vessel, while the other extends from the tubing annulus passage in the tree to the surface vessel.

Unfortunately, the need for the production of oil and gas has created shortages in the availability of such Christmas trees. Often, the well cannot be completed until such time as the Christmas tree is available. In certain circumstances, the Christmas trees may not be available for over six months. In order to accommodate this problem, it is necessary for drillers to partially drill the well and then plug the well or cement the well so as to block the release of hydrocarbons from the well. The drilling rig can then be moved to another location.

Ultimately, when the Christmas tree is available for installation on the wellhead, the driller will move the drilling rig back to the location of the original hole, remove the plug, and begin to complete the drilling of the well. After the well is completed, the Christmas tree can be installed using the drilling risers.

Presently, the drilling rig can cost approximately one million dollars per day. As such, there is a great deal of waste of time and money during the time in which the Christmas tree is not available. The driller must rent the drilling rig in order to partially complete the well, wait for the Christmas tree, and then recall the drilling rig so as to complete the production process. Under certain circumstances, the driller may actually have the Christmas tree available, but must wait for the drilling rig to be available for the completion of the well. Ultimately, after the well is completed, the Christmas tree can be installed as needed.

Under current environmental regulations, plugs for the production tubing are not suitable. Under certain circumstances, leakages could occur where plugs are temporarily installed in the production tubing. Whenever these leaks would occur, an environmental disaster would result. If a simple cap were placed over the production tubing, then the pressures caused by a leaking plug, would prevent the cap from being removed. Ultimately, if the cap were removed, then the built-up or pressures and the leakage through the plug would escape into the marine environment. As such, a need has developed so as to provide a capping associated whereby the well can be appropriately capped in order to accommodate environmental considerations. This cap should be inexpensive and reusable.

In the past, various patents have issued relating to such Christmas trees and the plugs associated therewith. For example, U.S. Pat. No. 5,299,641, issued on Apr. 5, 1994 to Paulo et al., describes a Christmas tree for subsea production. The Christmas tree has a connector at a bottom thereof for the purposes of locking to the wellhead. A guide structure is provided having a central ring attached to the connector.

U.S. Pat. No. 7,596,996, issued on Oct. 6, 2009 to Zollo et al., provides a Christmas tree with an internally positioned flowmeter. This is a measurement device that has structure adapted to be removably coupled to the Christmas tree. A sleeve is operatively coupled to the structure. The flowmeter is positioned at least partially within the sleeve.

U.S. Patent Publication No. 2007/0034379, published on Feb. 15, 2007 to Fenton et al., provides a plug installation for deep water subsea wells. A plug retrieval and installation tool is used with a subsea well having a production tree, a tubing hanger, a passage that extends vertically through the tubing hanger, and the tree. A plug is located within a plug profile in the passage within the tubing hanger. The plug retrieval device has a housing and connector that is lowered on a lift line onto the upper end of the tree. An axially extendible stem in the housing is moved with hydraulic fluid controlled by an ROV into the production passage of the tubing hanger. An installation and retrieval member mounted to the stem engages the plug and pulls it upwardly in the passage while the stem is being moved upwardly and pushes the plug downward to install the plug while the stem is being moved downward.

U.S. Patent Publication No. 2009/0260829, published on Oct. 22, 2009 to D. J. Mathis, provides a subsea tree safety control system for limiting the probability of failure on demand of the tree. This subsea shut-in system serves to actuate a safety valve on the tree. The safety shut-in system includes a surface control station positioned above a water surface connected via an umbilical to a subsea control system positioned below the water surface to actuate the safety valve. The safety-in system is diagnostically tested without actuating the safety valve.

U.S. Patent Publication No. 20110036562, published on Feb. 17, 2011 to K. Braekke, discloses a well plug having a flexible expandable sealing and a metallic anchor that can be moved radially out or in by rotating a leadscrew in opposite directions. The well plug has a ball valve in a central longitudinal passage which is kept open whenever the leadscrew rotates. This increases the accuracy when setting the plug and reduces the risk of the plug moving uncontrolled in the well bore during setting or retrieval. The ball valve can be opened or closed by rotating a transmitting shaft within an angle of free motion before the leadscrew is pulled along in the rotation.

It is an object of the present invention to provide a capping system which serves as an interim Christmas tree until a proper Christmas tree is available.

It is another object of the present invention to provide a capping assembly that can be easily installed over the tubing spool associated with wellhead.

It is another object of the present invention to provide a capping system having an interior passageway whereby a plug within the tubing spool can be removed through the interior of the cap.

It is another object of the present invention to provide a capping assembly which allows for the monitoring and measuring of pressure on the interior thereof.

It is a further object of the present invention to provide a capping assembly which can be installed and removed without the need for drilling riser equipment.

It is still another object of the present invention to provide a capping assembly which allows a Christmas tree to ultimately be installed without the need for drilling riser equipment.

It is still another object of the present invention to provide a capping assembly which is easy to use, easy to install and relatively inexpensive.

These and other objects and advantages of the present invention will become apparent from a reading of the attached specification and appended claims.

BRIEF SUMMARY OF THE INVENTION

The present invention is a cap assembly for use with a tubing spool of a wellhead. This cap assembly includes a body having an interior passageway. A mandrel extends upwardly from the body. The body has a connector extending from an end of the body opposite to that of the mandrel. The interior passageway extends though the mandrel and through the connector. A valve is affixed to the body and extends into the interior passageway. This valve is movable between a first position closing the interior passageway and a second position opening the interior passageway. An actuator is connected to the valve so as to move the valve between the first position and the second position.

A tubing hanger stab is affixed to the body and extends through the connector. The tubing hanger stab is suitable for joining with a tubing hanger in the tubing spool.

The valve includes a first valve affixed to the body and extending into the interior passageway and a second valve affixed to the body and extending into the interior passageway. The second valve is position in spaced relationship above the first valve. The body also has a channel formed therein. This channel is aligned with an annulus of production tubing in the wellhead. An annulus valve is positioned within the channel. A pressure sensor is cooperative with the interior passageway so as to sense a fluid pressure in the interior passageway. A closure is affixed over the mandrel of the body. A frame can also be affixed to the exterior of the body. The mandrel extends outwardly of an upper side of the frame. The connector extends downwardly below a bottom of the frame.

The present invention is also a system that comprises a wellhead, a production tubing extending through the wellhead, a tubing spool mounted on the wellhead, and a capping body affixed to the tubing spool. The tubbing spool has a tubing hanger therein. The production tubing is supported by this tubing hanger. The tubing spool has a mandrel extending upwardly therefrom. The capping body has an interior passageway. The capping body has connector at a bottom thereof. This connector is affixed to the mandrel of the tubing spool so as to align the interior passageway of the capping body with the production tubing. The capping body has a mandrel extending upwardly therefrom. The interior passageway of the capping body extends through the connector and through the mandrel of the capping body. At least one valve is affixed to the capping body and is cooperative with the interior passageway thereof. This valve is movable between a first position closing the interior passageway and a second position opening the interior passageway.

A plug is positioned in the tubing spool so as to seal the production tubing. The interior passageway of the capping body has a diameter greater than a diameter of the plug so as to allow the plug to pass through the interior passageway when the valve is in the second position. A tubing stab is positioned in the interior passageway of the capping body and extends through the connector thereof. The tubing stab is engaged with an interior of the tubing spool.

In the system of the present invention, the valve includes a first valve affixed to the body and extending into the interior passageway and a second valve affixed to the body and extending into the interior passageway. The second valve is position in spaced relation above the first valve. The production tubing extends through the wellhead so as to define an annulus on an exterior of the production tubing. The tubing spool has a channel in communication with the annulus. The capping body also has a channel cooperative with the channel of the tubing spool. The capping body has an annulus valve positioned in the channel of the capping body. A pressure sensor is cooperative with the interior passageway of the capping body so as to sense a fluid pressure in this interior passageway. A frame is affixed to an exterior of the body. The mandrel extends outwardly of an upper side of the frame. The connector extends downwardly through a bottom of the frame. The capping body has an actuator positioned on an exterior surface thereof. This actuator is operatively connected to the valve so as to allow an remotely-operated vehicle to move the valve between the first and second positions.

The present invention is also a method of closing a subsea well in which the well has a wellhead with production tubing extending downwardly therefrom into an underground formation. This method includes the steps of: (1) affixing a tubing spool to the wellhead; (2) connecting a capping body to the tubing spool; and (3) closing a valve in the interior passageway of the capping body so as to prevent fluid from the subsea well from flowing outwardly of the interior passageway. The tubing spool has a tubing hanger therein. The tubing hanger supports the production tubing. The interior passageway is aligned with the production tubing.

The method of the present invention further includes inserting a plug into the tubing spool so as to plug the production tubing. Ultimately, the method of the present invention has the valve opening so as to open the interior passageway of the capping body. The plug is engaged by a wireline extending through the interior passageway. The plug is removed by drawing the plug through the interior passageway. The capping body can then be removed from the tubing spool. A Christmas tree can then be placed upon the tubing spool so that the production system can operate as intended.

The foregoing Summary of the Invention is intended to describe the preferred embodiments of the present invention. The language used in this Summary of the Invention should not be construed, in any way, as limiting of the scope of the present invention. Ultimately, the scope of the present invention should be limited by the following claims and their legal equivalents.

DETAILED DESCRIPTION OF THE INVENTION

Figure 1:
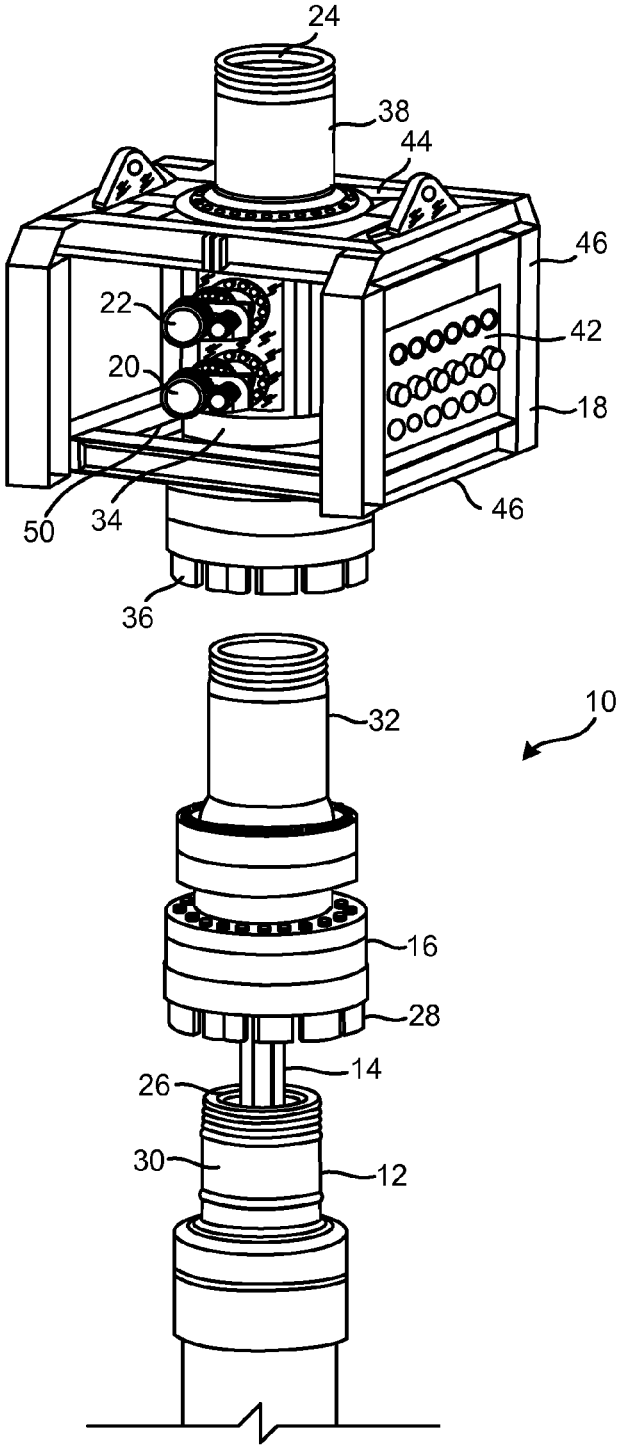
FIG. 1 is an exploded perspective view showing the capping system in accordance with the preferred embodiment of the present invention.

Referring to FIG. 1, there is shown the capping system 10 in accordance with the teachings of the present invention. The capping system 10 includes a wellhead 12 having production tubing 14 extending therethrough. A tubing spool 16 is illustrated as extending around the production tubing 14. The capping body 18 is positioned above the tubing spool 16. The capping body 18 has suitable valves 20 and 22 for the control of fluids, and other items, passing through the interior passageway 24 thereof.

The wellhead 12 is in the nature of a conventional wellhead. Ultimately, the production tubing 14 will extend through the interior passageway 26 of the wellhead 12 so as to extend downwardly into the subsea formation. Well fluids can pass through the production tubing 14 toward a surface location.

The tubing spool 16 will have a tubing hanger on the inside thereof. This tubing hanger will be described in association with FIGS. 2 and 3 hereinafter. The tubing spool 16 has a connector 28 at a bottom thereof. Connector 28 is suitable for engagement with the mandrel 30 located at the top of the wellhead 12. The tubing spool 16 also has a mandrel 32 at an upper end thereof.

The capping body 18 has a main body 34 with a connector 36 at a bottom thereof and a mandrel 38 extending from the top thereof. A frame 40 can be positioned around the main body 34. Frame 40 provides a structure so as to maintain the integrity of the main body 34 and also allow for the installation and removal of the main body 34. The frame 40 also allows for the positioning of pressure sensors 42 thereon. The mandrel 38 extends upwardly above the top surface 44 of the frame 40. The connector 36 extends downwardly below the bottom 46 of the main body 34. The interior passageway 24 extends through the mandrel 38, through the main body 34, and outwardly of the connector 36. The valve 20 is positioned so as to be cooperative with the interior passageway 24. The second valve 22 is positioned in spaced relationship above the first valve 20 and is cooperative with the interior passageway 24. The valves 20 and 22 are movable between a first position which serves to close the interior passageway 24 and a second position which serves to open the interior passageway 24. A suitable actuator 50 is provided with each of the valves 20 and 22. Actuator 50 is positioned on an exterior of the main body 34. The actuator 50 allows a remotely-operated vehicle (ROV) to be engaged therewith so as to move the valves 20 and 22 between the opened and closed positions.

Figure 2:
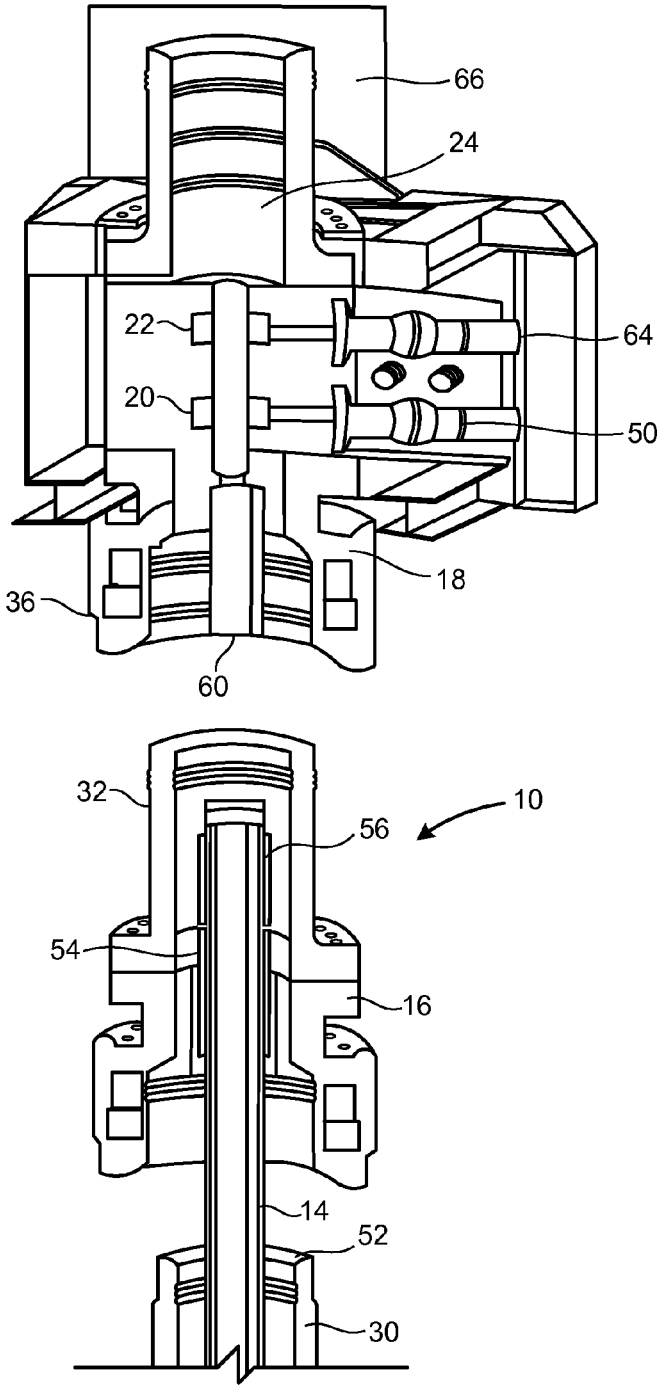
FIG. 2 is a cross-sectional view showing the capping system in accordance with the teachings of the present invention.

FIG. 2 is a cross-sectional view of the capping system 10 of the present invention. In FIG. 2, it can be seen that the production tubing 14 extends through the interior 52 of the wellhead 30. As such, the production tubing 14 will form an annulus within the wellhead 12 and within the casing associated with the well.

The tubing spool 16 receives an upper end of the production tubing 14 therein. Ultimately, a suitable tubing hanger 54 is positioned within the interior passageway of the tubing spool 16 so as to support the weight of the tubing upon shoulders therein. As such, the production tubing 14 is effectively retained by the tubing spool 16.

In FIG. 2, it can be seen that there is a plug 56 that is affixed over the upper end of the production tubing 54 and within the interior passageway of the tubing spool 16. Plug 56 is a conventional well plug that can be suitably expanded so as to engage the walls of the interior passageway of the tubing spool 16 and to effectively seal the production tubing 14. As such, the plug 56 should prevent well fluids from passing outwardly of the production tubing 14. It should be noted that there is a valve at the bottom of the production tubing 14 which also serves to prevent the inflow of production fluids into the interior of the production tubing 14 until such time as the Christmas tree is installed.

In normal use, the tubing spool 16 and the wellhead 30 will have the configuration illustrated in FIG. 2 upon the completion of the well. If a Christmas tree would have been available, then the Christmas tree would be installed upon the mandrel 32 of the tubing spool 16 and installed in a conventional manner. The plug 56 can be removed during the installation of the Christmas tree. However, if the Christmas tree is not available and if the production well is completed, then the capping body 18 can be applied so as to serve as an interim Christmas tree until the actual Christmas tree should become available.

In FIG. 2, the capping body 18 has the connector 36 at a bottom thereof. Connector 36 can be threadedly, or otherwise, engaged with the mandrel 32 of the tubing spool 16. A tubing stab 60 is provided within the connector 36. Tubing stab 60 will engage with the interior passageway of the tubing spool 16 so as to be in fluid-tight engagement therewith. As such, the interior passageway 24 of the capping body 18 will be aligned with the production tubing 16.

FIG. 2 shows that the first valve 20 and the second valve 22 are cooperative with the interior passageway 24. In particular, the valves 20 and 22 are illustrated in their closed configurations. As such, any fluid that would leak pass the plug 56 would be retained within the interior passageway 24 of the capping body 18. The flow of any well fluids is prevented from exiting the flow passageway 24 and from entering the marine environment because of the arrangement of the valves 20 and 22. Within the concept of the present invention, a single valve 20 could be utilized. However, for the purposes of redundant safety, a pair of valves 20 and 22 are provided. Valve 20 has the actuator 50 connected thereto and extending outwardly of the main body 34. The second valve 22 has an actuator 64 connected thereto and extending outwardly from the main body 34. Each of the actuators 50 and 64 is suitable for manipulation by an ROV. Suitable pressure sensors can be incorporated into the interior passageway 24 so as to measures the pressures therein. If there is a build-up of pressure, then this can be indicative of a leakage of a plug 56. As such, remedial measures must be taken so as to assure that any such leakage does not enter the marine environment. If the pressure within the interior passageway 24 should remain constant, then there clear evidence of no leakage through the plug 56. Under such circumstances, the capping body 18 can be removed when it is necessary to install the actual Christmas tree.

In FIG. 2, it can be seen that there is a closure 66 positioned over the open end of the interior passageway 24 and over the mandrel 38. This closure 66 acts as a trash cap so as to prevent debris from the marine environment from settling into the interior passageway 24 and, possibly, from causing problems with the operation of the valves 20 and 22.

In FIG. 2, the process of the present invention is clearly seen. Initially, the capping body 18 can be placed onto the mandrel 34 of the tubing spool 16. As such, the tubing stab 60 will be in fluid-tight relationship with the interior passageway of the tubing spool 16. In most circumstances, the plug 56 will operate properly and no leakage will occur. In the rare event of leakage, then valves 20 and 22 will serve to prevent any leakage of the hydrocarbons into the marine environment. Ultimately, if there is leakage beyond the plug 56, then remedial measures, such as the installation of a blowout preventor upon the mandrel 38, may be necessary. Ultimately, it would be necessary to bring in a drilling riser so as to assure that the well is killed or that remedial measures can be carried out. The mandrel 38 is provided so as to facilitate the ability to attach a blowout preventor under such circumstances.

If the plug 56 has carried out its proper function and no hydrocarbons are leaking past the plug 56, then the valves 20 and 22 can be opened so as to that access to the interior passageway 24 of the tubing spool 16 can be carried out. As a result, a wireline can be pass through the interior passageway 24 of the capping body 18 so as to engage the plug 56 so that the plug 56 can be removed. When the plug 56 is removed, the Christmas tree can be delivered from a surface location and delivered by conventional means to the subsurface location. Unlike the prior art, the present invention assures that the drilling rig will not be required. A boat can be utilized so as to deliver the Christmas tree. The Christmas tree can be winched into the water and delivered by an ROV for installation onto the mandrel 32 of the tubing spool 16. The capping body 18 can then be transported to the surface and delivered to another location.

Through the use of the system 10 of the present invention, it is not necessary to cement the well if the Christmas tree is not available. As such, the drilling rig can carry out its intended purpose and complete the drilling of the well. The wellhead 30 can be installed and the tubing spool 16 can be properly installed. The capping body 18 can then be placed over the mandrel 32 of the tubing spool 16 so as to create a proper cap well. This well remains capped until such time as the Christmas tree is available. The Christmas tree can then be easily delivered and installed in the manner described hereinbefore.

Figure 3:
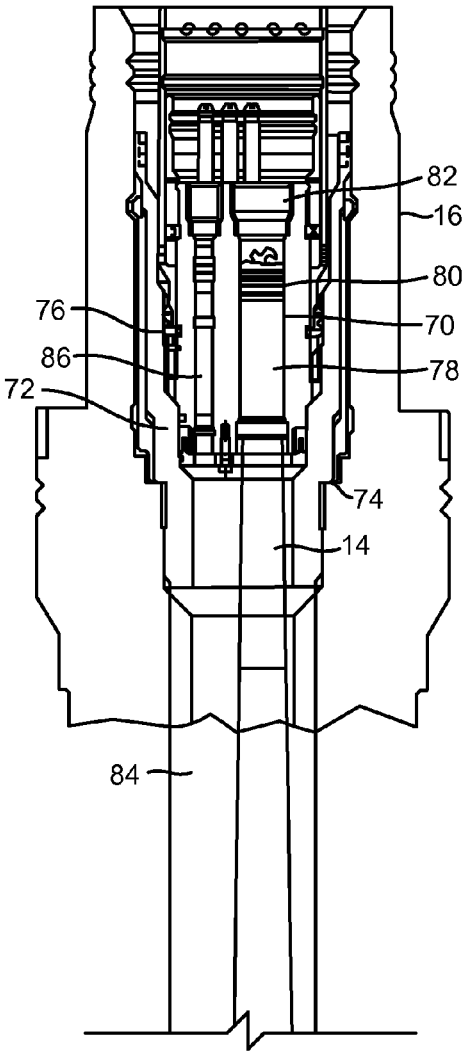
FIG. 3 is a cross-sectional view showing the arrangement of the tubing spool and plug as used in the capping system of the present invention.

FIG. 3 is an illustration of the construction of the tubing spool 16 of the preferred embodiment. The tubing spool 16 includes a rigid outer body 70. The production tubing 14 is illustrated as extending from the wellhead into the interior of the tubing spool 16. A tubing hanger adapter sleeve 72 is positioned within the interior of the tubing spool 16 so as to rest upon shoulder 74. The tubing hanger 76 is located within the interior of the tubing hanger adapter sleeve 72 so as to secure with the production tubing 14. Ultimately, a fluid passageway 78 communicates with the production tubing 14 within the interior of the tubing hanger 76. A plug 80 is illustrated as positioned onto an over the end of the production tubing 14 within the tubing hanger 76. Ultimately, the tubing stab 60 will enter the receptacle 82 so as to engage with the hole associated with the production tubing 14.

Figure 4:
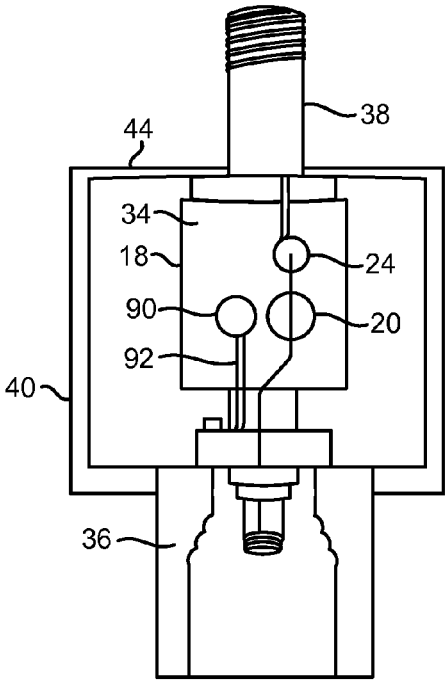
FIG. 4 is a side elevational view showing the arrangement of valves as used in the capping body of the capping system of the present invention.

In virtually all production activities, an annulus 84 is formed between the exterior of the production tubing 14 and the inner wall of the casing. A channel 86 is provided within the tubing spool 16. This channel will communicate with the annulus. Ultimately, the capping body 18 can have a channel in communication with this annulus channel 86 so as to allow for pressures within the annulus to be properly measured. The capping body 18 can include a suitable valve for assuring the closing of such channel FIG. 4 is an illustration showing the capping body 18. As can be seen, there is a first valve 20 and the second valve 24 associated with the interior passageway. An annulus valve 90 is associated with the channel 92 extending to the annulus channel 86 of the tubing spool 16. Suitable pressure gauges can be associated with the interior passageway 24 and with the channel 92 associated with the annulus 84.

FIG. 4 further shows that the receptacle 36 extends downwardly below the bottom of the frame 40. The mandrel 38 extends upwardly above the top 44 of the frame 40. The frame 40 serves to prevent any inadvertent damage to the main body 34 of the capping body 18. Additionally, the frame 40 can serve to allow for the positioning of pressure gauges, and other instruments, associated with the capping body 18.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. A system for capping and closing a well, the system comprising:

a wellhead;

a production tubing extending through said wellhead;

a tubing spool mounted on said wellhead, said tubing spool having a tubing hanger therein, said production tubing supported by said tubing hanger, said tubing spool having a mandrel extending upwardly therefrom;

a capping body having a single interior passageway which opens at a lower end and at an upper end of said capping body, said capping body having a connector at a bottom thereof, said connector affixed to said mandrel of said tubing spool so as to align said interior passageway of said capping body with said production tubing, said capping body having a mandrel extending upwardly therefrom, said interior passageway of said capping body extending through said connector and through said mandrel of said capping body, said capping body extending in end-to-end relationship with said tubing spool;

at least one valve affixed to said capping body and located within said interior passageway of said capping body and cooperative with said interior passageway thereof, said valve movable between a first position closing said interior passageway and a second position opening said interior passageway; and a plug positioned in said tubing spool so as to seal said production tubing, said interior passageway of said capping body having a diameter greater than a diameter of said plug so as to allow said plug to be removed by being pulled upwardly through said interior passageway when the valve is in the second position.

2. The system of claim 1, further comprising:

a tubing stab positioned in said interior passageway of said capping body and extending through said connector thereof, said tubing stab engaged with an interior of said tubing spool.

3. The system of claim 1, the valve comprising:

a first valve affixed to said capping body and extending into said interior passageway; and a second valve affixed to said capping body and extending into said interior passageway, said second valve positioned in spaced relation above said first valve.

4. The system of claim 1, said production tubing extending through said wellhead so as to define an annulus on an exterior of said production tubing, said tubing spool having a channel in communication with said annulus, said capping body having a channel cooperative with said channel of said tubing spool, said capping body having an annulus valve positioned in said channel of said capping body.

5. The system of claim 1, further comprising:

a pressure sensor cooperative with said interior passageway so as to sense a fluid pressure in said interior passageway.

6. The system of claim 1, further comprising:

a frame affixed to an exterior of said body, said mandrel extending outwardly of an upper side of said frame, said connector extending downwardly below a bottom of said frame.

7. The system of claim 1, said capping body having an actuator positioned on an exterior surface thereof, said actuator being operatively connected to the valve so as to allow a remotely-operated vehicle to move the valve between the first and second positions.

8. A method of closing a subsea well in which the well having a wellhead with production tubing extending downwardly therefrom into an underground formation, the method comprising:

affixing a tubing spool to the wellhead, said tubing spool having a tubing hanger therein, said tubing hanger supporting the production tubing;

connecting a capping body to an upper end of said tubing spool, said capping body having an interior passageway extending therethrough so as to open at an upper end and at a lower end thereof, said interior passageway being aligned with said production tubing, said capping body having a valve cooperative with said interior passageway;

inserting a plug into said tubing spool so as to plug said production tubing;

closing said valve within said interior passageway of said capping body so as to prevent fluid from the subsea well from flowing outwardly of said interior passageway;

opening said valve of said capping body so as to open said interior passageway;

engaging said plug by a wireline extending through said interior passageway; and removing said plug by drawing said plug through said interior passageway.

9. A system for capping and closing a well, the system comprising:

a wellhead;

a production tubing extending through said wellhead;

a tubing spool mounted on said wellhead, said tubing spool having a tubing hanger therein, said production tubing supported by said tubing hanger, said tubing spool having a mandrel extending upwardly therefrom;

a capping body having a single interior passageway, said capping body having a connector at a bottom thereof, said connector affixed to said mandrel of said tubing spool so as to align said interior passageway of said capping body with said production tubing, said capping body having a mandrel extending upwardly therefrom, said interior passageway of said capping body extending through said connector and through said mandrel of said capping body so as to open at an upper end and at a lower end of said capping body, said capping body extending in end-to-end relationship with said tubing spool;

at least one valve affixed to said capping body and located within and cooperative with said interior passageway thereof, said valve movable between a first position closing said interior passageway and a second position opening said interior passageway; and a plug positioned in said tubing spool so as to seal said production tubing, said plug positioned below said capping body so as to seal said production tubing, said interior passageway of said capping body having a diameter greater than a diameter of said plug so as to allow said plug to be removed by being pulled upwardly through said interior passageway when said valve is in the second position.

* * * * *